United States Patent [19]

Leins et al.

[11] 4,364,245

[45] Dec. 21, 1982

[54] KNITTING MACHINE

[75] Inventors: Eberahrd Leins, Filderstadt; Manfred Walter, Aichtal; Willi Gaiser, Gäufelden, all of Fed. Rep. of Germany

[73] Assignee: Sulzer Morat GmbH, Fed. Rep. of Germany

[21] Appl. No.: 224,671

[22] Filed: Jan. 13, 1981

[30] Foreign Application Priority Data

Feb. 2, 1980 [DE] Fed. Rep. of Germany ..... 3003811

[51] Int. Cl.[3] ..... D04B 7/00; D04B 15/36; D04B 35/00

[52] U.S. Cl. ..... 66/78; 66/64

[58] Field of Search ..... 66/78, 57, 60 R, 64 R, 66/54, 125, 62, 75.2

[56] References Cited

U.S. PATENT DOCUMENTS 4,103,517 8/1978 Schmid et al. ..... 66/75.1

4,173,874 11/1979 Sommer et al. ..... 66/125 R 4,204,414 5/1980 Vinnemann et al. ..... 66/145 R 4,287,728 9/1981 Schimid et al. ..... 66/125 R

*Primary Examiner*—Ronald Feidbaum

[57] ABSTRACT

Knitting machine with a needle bed in which knitting tools having projections are mounted for raising and lowering, with a cam unit which can be transported past the projections and which has at least one lowering cam acting on the projections of the knitting tools which is adjustable with regard to its lowering depth, on which a runner is movably fastened having a plurality of pathways interacting according to pattern with the runner during the carrying of the cam unit past the projections of the knitting tools for the adjustment of the lowering cam to a preselected lowering depth, and with a controller acting before each passage of the cam unit past the feet of the knitting tools for the shifting of the runner to the position required for the interaction with a selected pathway (FIG. 7).

21 Claims, 13 Drawing Figures

KNITTING MACHINE

BACKGROUND

The invention concerns a knitting machine of the kind defined in the generic part of claim 1.

In knitting machines of this kind (e.g., German OS Nos. 2,531,705, 2,531,734 and 2,531,762, the rails controlling the cam units are usually provided above the butts or projections of the knitting tools, and are intended to act upon lowering means resiliently disposed on the cam units for the purpose of displacing them during the movement of the cam units past the knitting tools to such a position relative to the needle bed that the knitting tools are lowered by the amount called for by the pattern for the formation of the stitches.

Since it can be desirable for reasons of pattern to adjust succeeding lowering means to a variety of different lowering or coulier depths, it is already known (German OS No. 2,531,705) to provide above each needle bed a group of rails which are adjustable in level in accordance with the desired lowering depth, and to provide on each lowering means or carrier thereof a number of grooves corresponding to the number of pathways into which the runners in the form of plates can be inserted in order to associate each lowering means with a selected pathway. Such devices, however, are not suitable for a variation of the lowering depth while the knitting machine is in operation.

To make it possible to adjust the lowering means with the knitting machine running, it is furthermore already known (German OS NO. 2,531,705) to provide controllable actuators disposed outside of the needle beds for the preadjustment of each lowering means or means for the adjustment of the lowering means cooperating with shims of different thickness. Apparatus of this kind are relatively complex and therefore liable to trouble, and either they increase the amount of space required for the knitting machine or they interfere with access to the stitch-forming parts thereof.

It is the aim of the invention, therefore, to improve a knitting machine of the kind described above such that the setting of the lowering depth of each individual lowering means before it moves past the knitting tools can be accomplished by simple means and by a simple method of operation.

To achieve the aim, the specific features of claim 1 are provided.

The invention offers the advantage that the setting of the lowering depth of each lowering means can be accomplished before it runs past the knitting tools by the mere operation of the actuator. It is therefore necessary neither to deliver control signals to moving parts such as the cam units, for example, nor to stop these parts momentarily during the operation of the knitting machine for the purpose of adjusting the lowering depth. In addition, the actuator can in accordance with the invention consist of a simple arrangement of switches which deliver the runners, prior to each movement of the lowering elements past the knitting tools, to the pathway which is required according to the pattern for the adjustment of the lowering depth.

Additional advantageous features of the invention are specified in the subordinate claims.

The invention will be further explained below in conjunction with embodiments represented in the appended drawings, wherein.

Figure 1:
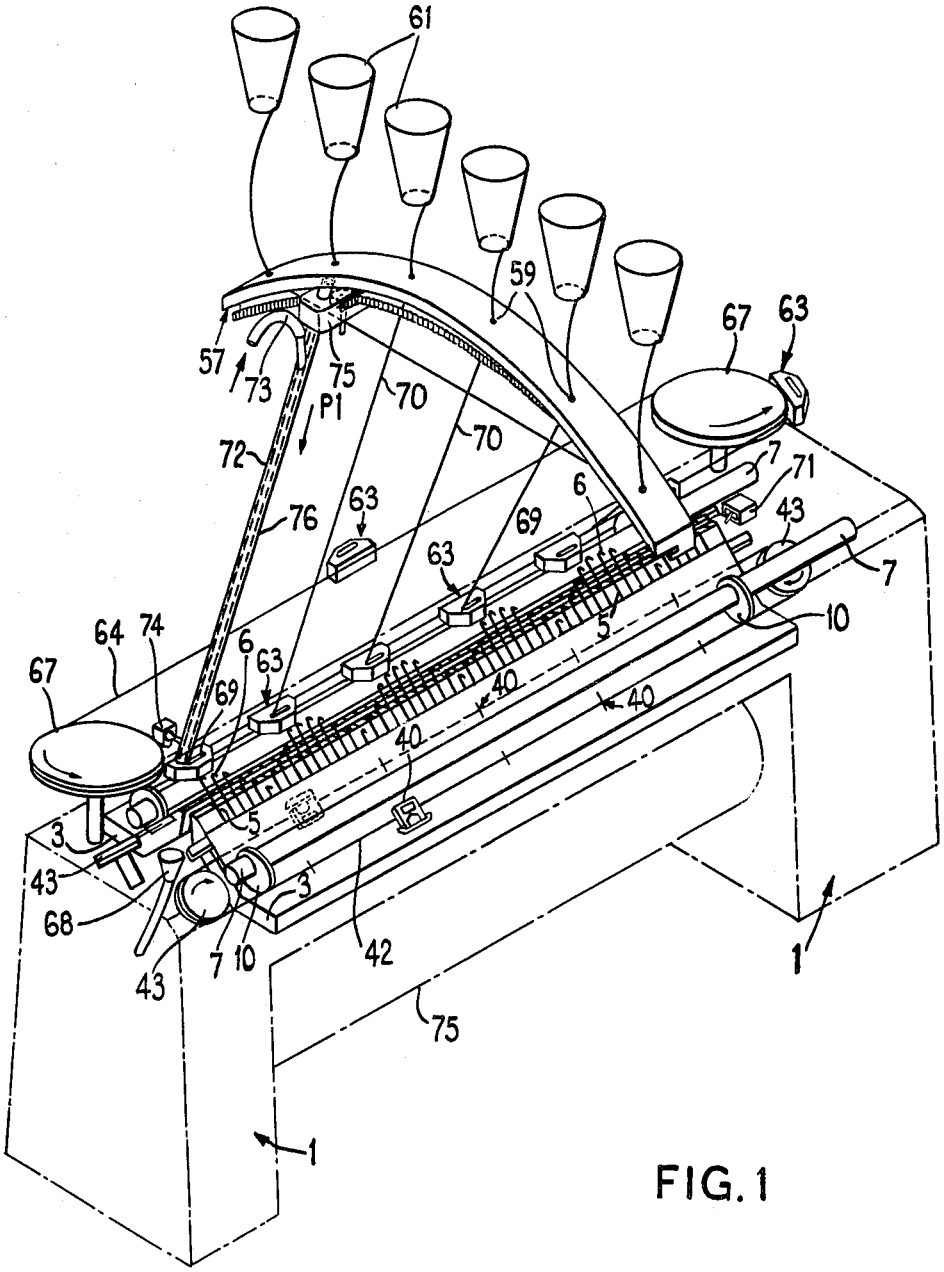
FIG. 1 is a perspective view of a knitting machine in accordance with the invention.
Figure 2:
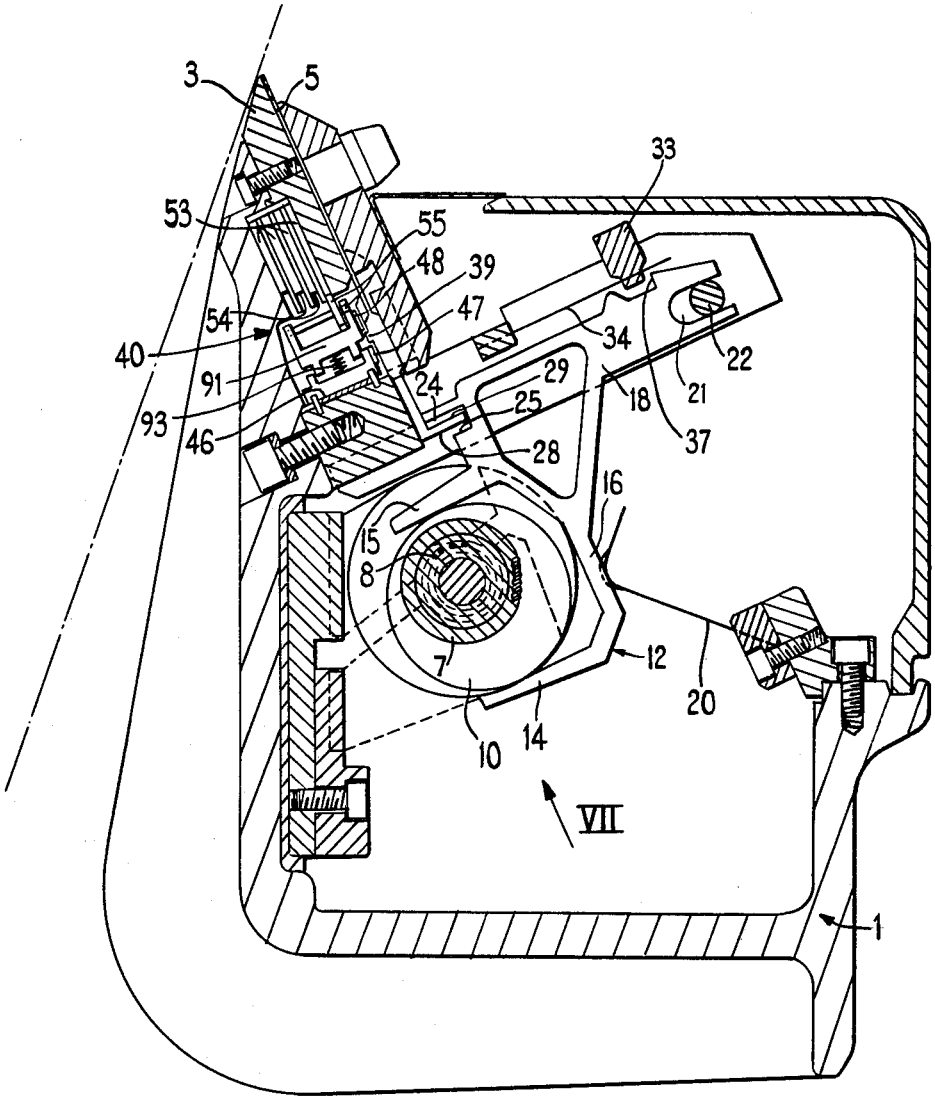
FIG. 2 is a cross section through a needle bed of the knitting machine of FIG. 1.

In FIGS. 1 and 2 there is shown a flat knitting machine in accordance with German Offenlegungsschrift No. 2,531,705. In a frame 1 two needle beds 3 are fixedly mounted in an inverted vee arrangement, and in their grooves knitting needles 5 with hooks 6, preferably latch needles, are mounted for longitudinal displacement in a known manner. In each needle bed 3 a drive shaft 7 is rotatably mounted in bearings 8. On the drive shafts 7 and corotational therewith there are mounted a number of control cams 10 corresponding to the number of knitting needles 5, these cams being in an offset angular relationship to one another. On each cam 10 there is placed, as seen in FIG. 2, a driver 12 which is in the form of a fork having two tines 14 and 15 united by a back 16 acting as an engaging member. The two tines 14 and 15 grasp the cam 10 on two sides such that their points of contact with the cam 10 are on a line that is substantially parallel to the needle axes, so that the drivers 12 are raised and lowered parallel to the needle axes by the control cams 10 when the drive shafts 7 rotate, and thus perform raising and lowering movements.

On the same side of the driver 12 as the back 16 there is provided an arm 18 which is mounted in a sliding and turning bearing formed by an elongated hole 21 in arm 18 and a shaft 22 fastened in the frame 1 and extending through the elongated hole 21, so that the driver 12 will, on the one hand, be held in engagement with the cam 10 by the action of a leaf spring 20 engaging the back 16, and on the other hand will be displaceable and rotatable on account of the sliding and turning bearing 21, 22.

In an upper section of the driver 12 there is provided an opening whose upper edge serves as a lowering means 24 and whose lower edge serves as a raising means 25 raising the butt of the knitting needle 5 associated with it, whose bottom edge is accordingly to be considered as a raising means 28 and whose upper edge is to be considered as a lowering means member 29. The lowering means 24 is of such a length that it overlaps the lowering means 29 during the lowering action of the control cam 10 in every possible position of the driver 12, while on the other hand the raising means 25 is so short that only when the back 16 is in the engaging position seen in FIG. 2 will it be able to engage the raising means 28 of the needle butt, but when the back 16 is in a disengaging position it will be out of reach of the raising means.

For the selection of the knitting needles 5 according to pattern, a selector device is provided for each, which in this embodiment comprises a pattern-controlled holding magnet 33 and a leaf spring 34 held at one end, which can be applied to the pole face of the holding magnet by means of a projection provided on the arm 18. If the holding magnet 33 attracts the leaf spring 34, the fork back 16 is applied by the biasing spring 20 to the corresponding control cam 10, so that the raising means 25 will overlap the raising means 28 of the needle butt. If the leaf spring 34, however, is not attracted by the holding magnet 33, its bias pulls it away from the pole face and it engages a stop 37 formed on the arm 18, so that the fork back 16 is arrested in a retracted position against the action of the biasing spring 20 and the raising means 25 will be out of reach of the raising means 28.

Each knitting needle 5 has a projection 39 which can cooperate with a plurality of cam units 40 which are fastened to endless belts or chains 42 which are mounted on pulleys 43 and are driven by means of a drive which is not represented. In the area of the two needle rows, the cam units 40 run on stationary parallel tracks 46 and 53 disposed parallel to the needle beds 3 and extending over the entire length of the needle beds, so that as they run past the needles 5 they are always at the same unvariable height.

Figure 3:
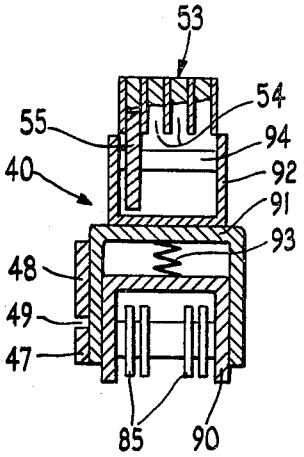
FIG. 3 is a cross section through a cam unit in accordance with the invention.
Figure 4:
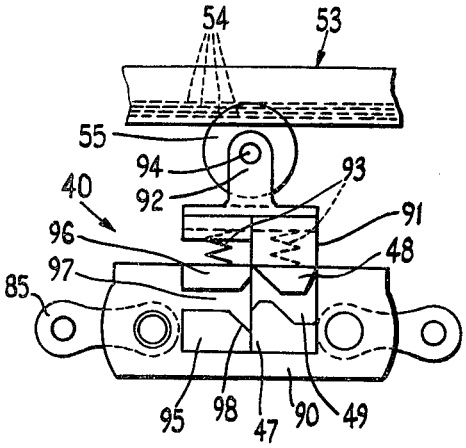
FIGS. 4 and 5 are front views of the cam unit of FIG. 3, wherein the lowering cam is in the uppermost position in FIG. 4, but in the lowermost position in FIG. 5.
Figure 5:
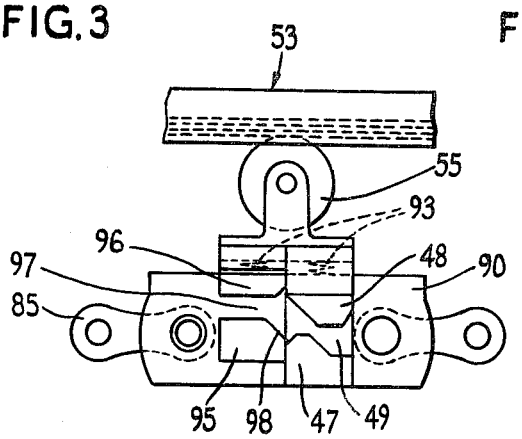

As seen in FIGS. 3 to 5, each cam unit 40 has a lowering cam 48 acting in the lowering direction and a raising cam 47 sloping in the raising direction, these cams defining a passage 49 in which the projections 39 of the knitting needles 5 enter so as first to be lowered by the lowering cam 48 to form a stitch and then to be returned by the raising cam 47 to the normal open-passage position. Each cam unit 40 contains an inner channel-shaped component 90 which is fastened to a chain link 85 and cooperates with the track 46, and an outer channel-shaped bracket 91 displaceably disposed on the inner channel-shaped component 90, which interacts with one of several rails of a track 53 which are disposed parallel to one another in a spaced-apart relationship, a compression spring 93 being provided between component 90 and bracket 91, which in the released state urges the bracket 91 to a certain position on component 90. In an upper portion of the bracket 91 there are provided brackets 92 provided with a shaft on which a trolley in the form of a wheel 55 is mounted for rotation and axial displacement, which determines the position of bracket 91 on component 90 when the cam units 40 enter into the space between the tracks 46 and 53.

As best seen in FIGS. 3 to 5, the two cams 47 and 48 are fastened to the bracket 91, the lowering cam 48 producing the lowering action and the raiser cam 47 producing the return to the normal open-passage position which is then required. The two cams 47 and 48, which define the passage 49, are adjoined by two additional cams 95 and 96 which define a passage and are fastened to component 90, the lower cam 95 having a slope 98 which terminates at the level of the normal open-passage position and there merges with a horizontal section.

When component 90 lies upon the track 46, the track 53 serves as a counter-support for bracket 9 and for the guidance of its wheel 55. For the selection of the depth of the lowering action produced by the lowering cam 48, a plurality of rails 53 are provided which heave each a tread 54 (FIG. 2) at different levels with respect to the lowering cam 48. The wheel 55 which is displaceably mounted on the top of bracket 91 can assume a number of positions corresponding to the number of treads 54 of the rails of track 53, can thus be brought into contact with each tread 54 and accordingly can determine the position of bracket 91 with respect to component 90. In this manner it is possible to adjust the coulier action or lowering action of each individual cam unit differently in each movement past the knitting needles.

In FIG. 4, the lowering cam 48 is assuming its highest position corresponding to the minimum lowering action, while in FIG. 5 it is in the position in which the lowering cam 48 is forced against the pressure of spring 93 to the lowermost position corresponding to the maximum lowering action.

The cam units 40 are, in the case of the special type of knitting machine of FIGS. 1 and 2, disposed at such a height relative to the projections 39 that the latter are unable to enter into the passage 49 until the knitting needles 5 have been lowered by the lowering means 24 of the drivers 12 virtually all the way to the normal open-passage position. The lowering cams 48, therefore, become active only at the end of a full downward action of the control cams 10, and produce only that small portion of the descent which serves to form a stitch or to pull the thread loop formed by a hook 6 through the previously formed stitch located on the needle shank, while the greatest part of the lowering action is performed by means of the driver 12 driven by the control cam 10. To prevent the additional downstroke produced by the lowering cam 48 from interfering with the downstroke produced by the driver, the arrangement is made such that the distance between the lowering cams 24 and the raising cams 25 of the drivers 12 is greater than approximately the distance between the raising means 28 and the lowering means 29 of the knitting needle 5, as it corresponds to the maximum additional downstroke achievable with the lowering cam 48, i.e., such that the driving connection between the needle 5 and the control cam 10 has sufficient free play such that the needle 5 is movable in the direction of its movement by a sufficiently great amount in addition to the movement produced by the control cam 10.

Figure 6:
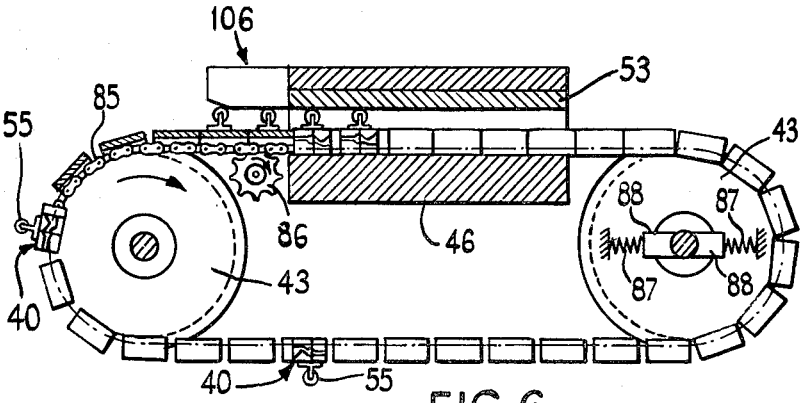
FIG. 6 represents a means for driving the cam units seen in FIG. 1.

FIG. 6 presents a diagrammatic representation of a transport apparatus whereby the cam units 40 are carried such that the lowering cams always being to act on a projection 39 when the corresponding knitting needle 5 has been drawn by the corresponding driver 12 almost to the open-passage position. The chain links 85 are joined to one another with clearance. The pulley 43 at the right side of FIG. 6 is slightly braked by means of drag shoes 88 biased by springs 87, while the drive pulley 43 on the left side of FIG. 6 is driven at the knitting speed. The cam units 40 have a length, measured in the direction of movement of the chain, corresponding to the length of the knitting systems, so that they will abut against one another by partially closing up the clearance between the chain links. The driving of the cam units 40 can also be accomplished by providing a sprocket 86 (FIG. 6) which is disposed at a point ahead of the beginning of the goods being knitted.

For the feeding of the threads, the apparatus that can be seen in FIG. 1, for example, can be used (cf. German Offenlegungsschrift No. 2,531,734), which has a support 57 for thread eyelets 59 disposed above the machine frame, and above them the same number of pirns 61 as the number of eyelets are present. In the vicinity of the hooks 6 of the knitting needles 5, when they are in their raised position, there is provided a plurality of thread carriers 63, which are carried by means of endless belts 64 mounted on pulleys 67 along a line parallel to the needle belts, past the knitting needles. Each thread carrier 63 has an eyelet 69 into which threads 70 coming from any pirn 61 can be inserted. When the thread carriers 63 move in the direction of the arrows marked on the pulleys 67, there is at the right ends of the needle beds as shown in FIG. 3 a clipper 71, which is known in itself, is provided for cutting off the thread 70 presented by any thread carrier 63 as soon as it has been caught by the last knitting needle 5 which acts on these threads.

For the return of the thread end made free by the clipper to the left end of the needle beds 3 as seen in FIG. 1, and to prevent the threads from tangling, an air tube 72 is provided whereby compressed air from a tube 73 connected to a compressed air source is blown in the direction of the arrow P1. The bottom end of the air tube 72 is disposed closely above the point past which the eyelets 69 move, and is mounted in a ball joint 74. The upper end of the air tube 72 can be disposed by means of a pivot mechanism 75 just below each thread eyelet 59, and is so constructed that in conjunction with a compressed air feed it exercises a combined aspirating and blowing action. Each air tube 72 furthermore has a lateral slit 76 which on the one hand assures a perfect transport of the thread in the air tube, but on the other hand permits a thread in the air tube to be drawn out laterally after it has been inserted into an eyelet 69. The air tubes 72 serve to draw the free thread ends obtained by the clipper 71, when the upper end of an air tube 72 has been adjusted to the corresponding thread eyelet 59, first to the upper end of the air tube 72, and then to transport it from there through the air tube 72 and the eyelet 69 of an associated thread carrier 63 to its bottom end, where the free thread end is held by means of an air vacuum device 69 until, as the associated thread carrier 63 continues on, it is inserted again into a number of hooks 6 and has been worked by them into a stitch. Alternatively, the thread feed can be arranged such that the threads are fed to the thread carriers alternately from the one or the other side of the circulation path provided for the thread carriers (see German Offenlegungsschrift No. 2,701,652).

The manner of the operation of the knitting machine described above is known (see German OS No. 2,531,705), so that no further details need be provided.

The track 53 provided for the adjustment of the lowering cams 48 to the lowering or coulier depth desired in the individual case, on whose treads 54 the wheels 55 roll, are disposed with their length parallel to the needle beds 3 and parallel to the direction of movement of the cam units 40 as they run past the projections 39 of the knitting needles 5. On the other hand, as the cam units 40 run past the projections 39, the axles 94 of wheels 55 are disposed perpendicular to the direction of movement of the cam units 40 and perpendicular to the treads 54, so that each wheel 55 can be made to engage any desired tread 54 by a shifting it axially before it reaches the track 53.

A control device 106 (FIG. 6) serves for the preadjustment of the wheels 55, being situated at the start of the track 53, i.e., at the left hand end of the track 53 as seen in FIGS. 1 and 6. The control device can have mechanical, electrical, magnetic, hydraulic, pneumatic and other means for the purpose of adjusting the wheel to a tread 54 selected according to pattern.

A first embodiment of the control device 106 will now be described with reference to FIGS. 7 to 9.

After the cam units 40 have passed the pulleys 43 disposed on the entrance end of the needle beds (FIGS. 1 and 6), they are first carried past a restoring cam 101 (FIG. 7) which is disposed parallel to the needle beds 3 and has a cam surface 102 acting perpendicularly to the transport direction, onto which one face 56 of the wheel runs, such that the wheel is shifted on axle 94 to an end position, e.g., the end position on the right side in FIG. 3, since FIG. 3 is an elevational view from the right end of the needle bed. The spring 93 is at this time in its virtually relaxed state, while the lowering cam 48 assumes its uppermost position shown in FIG. 4.

Figure 7:
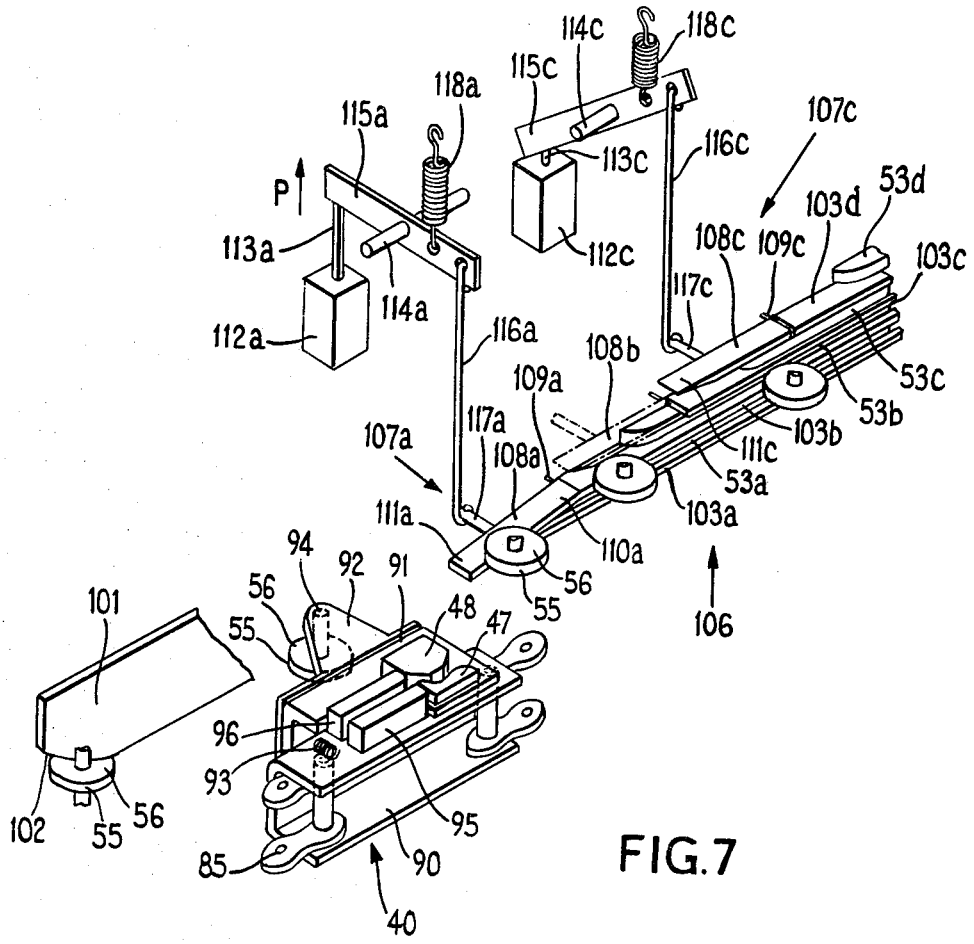
FIG. 7 is a diagrammatic, perspective view of a controller of the invention for the adjustment of the lowering depth in the direction of the arrow VII of FIG. 2.
Figure 8:
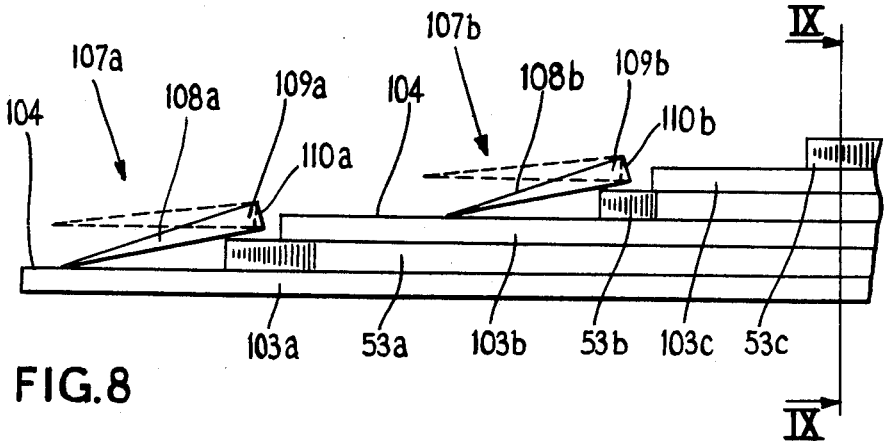
FIG. 8 is a diagrammatic enlarged top view of a portion of the controller of FIG. 7.
Figure 9:
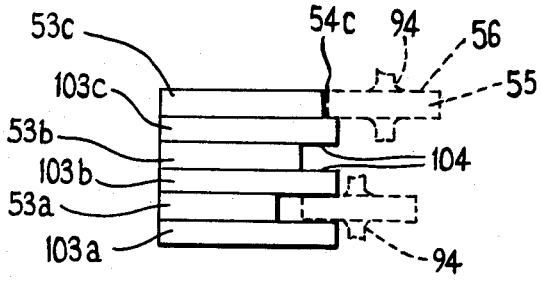
FIG. 9 is a cross section along line IX—IX of FIG. 8.

As best seen in FIGS. 7 and 8, the first sections of the rails of track 53 provided after the restoring cam 101 are offset from one another, one rail **53*a* beginning farthest left, as seen in FIGS. 1 and 6, while the other rails 53*b*, 53*c*, 53*d*, etc., begin each progressively further to the right. On both sides of the rails and between the rails 53*a* to 53*c* there are provided guides 103*a*, 103*b*, 103*c*, 103*d* etc., whose initial sections are also offset from one another. In FIGS. 7 and 8, the initial portion of guide 103*a* is farthest left, and is ahead of the initial section of the rail 53*a*, while the initial sections of guides 103*b*, 103*c*, 103*d* etc. are situated each between the initial sections of the adjacent rails 53*a* and 53*b*, 53*b* and 53i c**, etc.

The rails 53 are provided with treads 54 which are situated at different distances from the cam units 40. In particular, rail **53*a* can be farthest away from the cam units, so that, when it engages the wheel 55 of a cam unit 40, it will keep the cam unit virtually in the highest position as seen in FIG. 4, corresponding to the least lowering depth of the corresponding lowering cam 48. On the other hand, the rails 53*b*, 53*c* etc. can be situated progressively further out, so that their treads 54*b*, 54*c* etc. will force the corresponding lowering cams 48 to progressively lower positions against the force of springs 93, corresponding to a lower depth for the knitting needles 5**.

The guides 103 all reach the same distance towards the wheels 55, and they have guide surfaces 104 disposed perpendicular to the treads 54, against which the faces 56 of the wheels 55 can rub, and which serve to keep the wheels in engagement with a selected tread 54 while they are rolling past the projections 39.

For the application of the wheels 55 to a selected tread 54, a control device 106 is preferably provided, which, as shown in FIGS. 7 and 8, has a number of switches **107*a*, 107*b* etc., which are disposed successively in the direction of movement of the cam units 40, and serve for the deflection of the wheels 55 according to the pattern, and for the purpose of causing the wheel 55 of a cam unit 40 entering into the control device 106 to interact with a selected tread 54 during its subsequent movement along the needle beds 3**.

Each switch **107*a*, 107*b* etc., has a switch tongue 108*a*, 108*b*, etc., which can pivot on a pivot pin 109*a*, 109*b* etc., and a butt end 110*a*, 110*b* etc. adjoining a guide rail 103, and having a thickness corresponding substantially to the thickness of the guide 103, and a front end 111*a*, 111*b* etc. tapering to a sharp point, which can be applied to one of the guide surfaces 104. The switch tongues 108 are disposed at intervals from one another. In particular, the switch tongue 108*a* is so disposed that its butt end 110*a* terminates close to the initial section of guide 103*b*, while its front end 111*a* can be applied to the facing guide surface 104 of guide 103***a* such that the tongue covers over the initial section of the rail 53*a* situated between them. A wheel entering from the left in FIGS. 7 and 8 and rolling on the surface 104 of the guide 103*a* as the cam unit 40 continues to be transported would be shifted by the switch tongue 108*a* onto the guiding surface 104 of guide 103*b* if the switch tongue 108*a* were in the position represented by solid lines in FIG. 8, in which its front end lies on the guide 103*a*, while on the other hand the wheel 55 of this cam unit 40 is left unaffected by the switch tongue 108*a* and therefore, as the transport continues, continues to roll on the guiding surface 104 of the guide 103*a*, if the switch tongue 108*a* assumes the position represented in broken lines in FIG. 8 and therefore its front end is raised to such an extent that the wheel 55 can pass below the switch tongue 108*a*.

A wheel 55 which is not affected by the switch tongue 108*a* will first roll onto the tread 54*a* of the rail 53*a*, and then its faces 56 will pass between the two guides 103*a* and 103*b*, so that it will interact with tread 54*a* during its entire movement past the needle beds. A wheel that is affected by the switch tongue 108*a*, however, will, after passing over the switch tongue 108*a*, run with its face 56 onto the guide surface 104 of the next guide 103*b*, so that, when the next switch tongue 108*b* in the transport direction is in the position represented in broken lines in FIG. 8, in which its forward end 110*b* is lifted sufficiently far away from the guide 103*b*, will roll with its tread 56 onto the rail tread 54*b*, and then its faces 56 will pass between the two guides 103*b* and 103*c*.

The switches 107*b*, 107*c* etc. are constructed in substantially the same manner as switch 107*a*, and are associated each with a pair of guides 103*b* and 103*c*, 103*c* and 103*d*, etc. Therefore, by the appropriate setting of the switches 108, the wheel 55 of each entering cam unit 40 can be brought onto any of the treads 54, and thus the lowering cam 48 can be brought to any of the positions provided for on the basis of the preselected lowering depth.

Once the cam units have been transported past the needle beds 3 and the projections 39 of the knitting needles, they are led, as shown in FIG. 6, by the pulley 43 provided at the end of the needle beds onto a return trace, and from there to the pulley 43 provided at the beginning of the needle beds; after they pass pulley 43 they first run back against the restoring cam 101 in order to restore the wheels 55 to a preselected starting position. Then the cam units 40, and with them the wheels 55, again pass through the control device 106 and can then again be preset to the position desired for the next run past the needle beds.

To operate the switch tongues 108 in accordance with the pattern, an electromagnetically operated controller is provided which, as shown in FIG. 7, has one solenoid coil 112*a*, 112*b* etc. for each switch tongue 108*a*, 108*b* etc. The plunger 113*a*, 113*b* etc. of each solenoid coil 112 is attached to the one arm of each of the levers 115*a*, 115*b* etc. fulcrumed on a pivot pin 114*a*, 114*b* etc., the other arm being linked to a pull rod 116*a*, 116*b* etc., which is articulated to a pin 117*a*, 117*b* etc. fastened to the switch tongue 108*a*, 108*b* etc. The arms of levers 115*a*, 115*b* etc. which are articulated to the pull rods 116*a*, 116*b* etc., are furthermore biased to a selected position by springs 118*a*, 118*b* etc., preferably tension springs. At the same time the arrangement is made such that the arms of the levers 115 are biased by the springs 118 when the solenoids 112 are deenergized, the corresponding switch tongues 108 will be in the position shown in broken lines in FIG. 8, in which they leave the entering wheels 55 unaffected, as represented in FIG. 7 in the case of the switch tongue 108*c*. The energizing of the solenoids 112 such that their plungers 113 are pushed in the direction of the arrow P (FIG. 7), however, will result in a pivoting of lever 115 against the force of the springs 118, so that the pointed ends of the switch tongues 108 are laid against the confronting guide surface 104 of the associated guide 103, as indicated in solid lines in FIG. 7 and represented in FIG. 7 in the case of switch tongue 108*a*.

By appropriately controlling the solenoids, the wheels 55 can be made to interact with each preselected tread 54 according to the pattern. This results in the advantage that the solenoids 112 need only to be energized briefly, since the switch tongues 108 can be brought back to the open position immediately after the wheels 55 run onto them.

Figure 10:
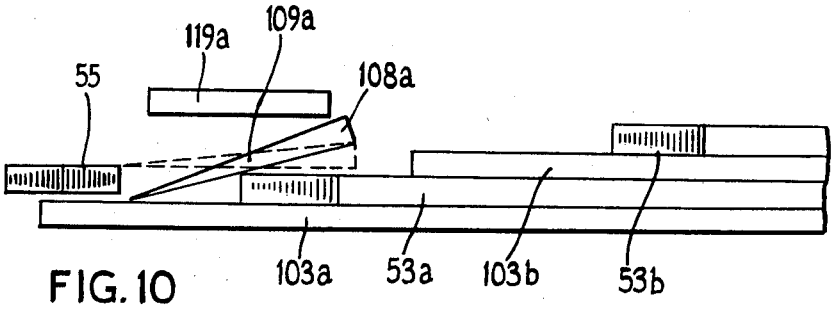
FIGS. 10 to 12 and 13 represent a second and third embodiment, respectively, of the controller.
Figure 11:
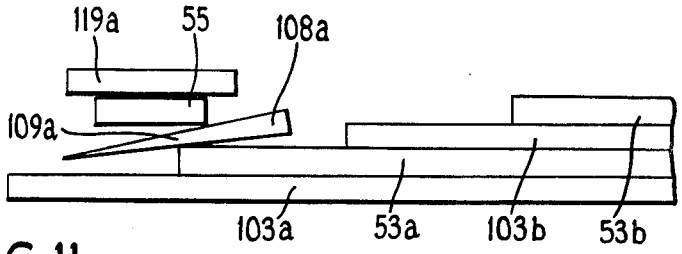
Figure 12:
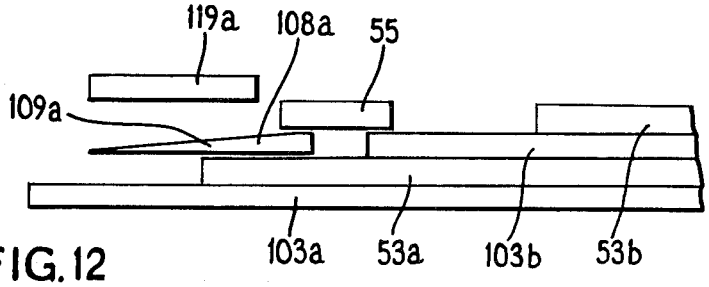

According to a preferred embodiment, which is represented diagrammatically in FIGS. 10 to 12 in conjunction with a single switch tongue 108*a*, the switch tongues 108 are made or disposed in the manner of a see-saw. As in the case of the embodiment described in conjunction with FIGS. 7 to 9, the switch tongue can be in the open position (broken lines) or in the closed position (solid lines) when a wheel 55 reaches it. If a wheel 55 is deflected by a switch tongue 108*a* that is in the closed position, its face confronting the guide face 104 of the guide 103*a* strikes against a counter-guide 119*a* as soon as its edge contacting the switch tongue 108*a* has passed the pivot pin 109*a* set in a central portion of the switch tongue 108*a*. Thus a force is exerted on the arm of switch tongue 108*a* on the right side of the pivot pin 109, which seeks to rock the switch tongue 108*a* to its open position. As the movement continues the switch tongue 108*a* is then finally closed entirely by the wheel 55 and the counter-guide 119*a* controlling the wheel (FIG. 12). The counter-guide 119*a* can extend in the transport direction all the way to the next switch, which is not represented in FIGS. 10 to 12.

A special advantage of the embodiment shown in FIGS. 10 to 12 is seen in the fact that the plungers 113 are positively returned to their place and the only purpose of the springs 118 is to hold the switch tongues 18 in the open position. Therefore, on the one hand relatively weak springs 118 can be provided, and on the other hand relatively weak solenoids 112 can be used. Aside from that, the positive opening of the switches 108 brought about by the counter-guide 118 assures that the switch tongues 108 will be reliably reopened after a wheel 55 passes by, and will not be left in a half-open position due to jamming or the like, which might cause the next wheel to run against a half-open switch 108 and destroy it.

Figure 13:
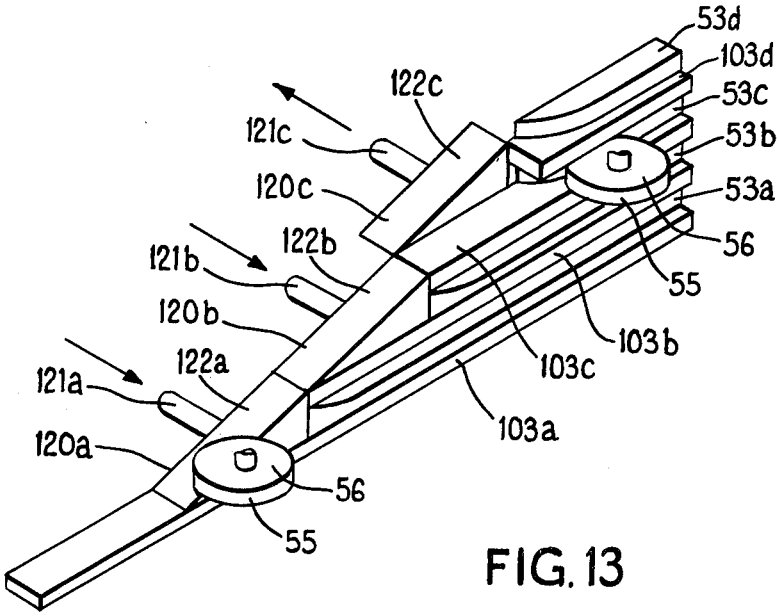

In the case of the third embodiment of the controller of the invention represented in FIG. 13 in a view corresponding to FIG. 7, instead of the switch tongues 108, switches 120*a*, 120*b*, 120*c* etc. are provided in the form of wedge-shaped slides, each having a control shank 121*a*, 121*b*, 121*c* etc. projecting perpendicular to the length of the guides and rails 103 and 53, respectively. These control shanks 121 are connected to actuators in the form of solenoids, hydraulic jacks or the like, which are not shown, and which act in the direction of the arrows (FIG. 13), whereby the switches 120 can be displaced to an active position like the switches 120*a* and 120*b* represented in FIG. 13, and to an inactive position like the switch 120*c* represented in FIG. 13.

The switches 120 each have a ramp surface 122*a*, 122*b*, 122*c* etc. which, when the switches 120 are in the active position, begin at a guide surface 104 of an associated guide 103 and end at the start of the corresponding guide surface 104 of the next guide 103, bypassing the starting section of a rail 53. Consequently, when a wheel 55 passes a switch 120 that is in the active position, it is associated with another rail 53, as is the case if it should pass over a switch 108, if the latter is in the position represented in solid lines in FIG. 8. However, a wheel 55 is not influenced by the switch 120 when the latter is in the inactive position, as in the case of the switch 108 represented in broken lines in FIG. 8.

The invention is not limited to the embodiments described above. Particularly the form and the arrangement of the guides, rails, treads and counter-guides represented can be freely selected within wide limits. It is recommended especially to round over the front ends of the rails 54, as indicated in FIG. 7, in order to facilitate a gentle engagement by the associated wheels 55. Furthermore, it is not necessary for the coulier depth or lowering depth to be progressively greater from one rail to the next as in FIG. 9. Instead, it is possible to associate with the foremost (lowermost) rail the lowering depth that is to be most frequently used, since this depth can be achieved without any displacement of the switches. It is especially desirable to mount the rails 53 such that their treads 54 can be adjusted individually to the lowering depth desired in a particular case, before the knitting process begins. For this purpose the rails are provided, for example, with guide slots extending along their length, through which guide pins pass, so that a displacement of the rails 53 in the lengthwise direction will result simultaneously in an upward or downward displacement of the corresponding treads 54, and hence in a corresponding change of the lowering depth. Instead of the solenoids 112 and the other parts provided for the movement of the switches, other parts serving the same purpose can be used. In particular, even in the case in which the selection of the needles is performed by electromagnetic means, purely mechanical means can be provided for the operation of the switches. The switches can be replaced by other control means.

Furthermore, the invention is not limited to flat knitting machines of the type described in conjunction with FIGS. 1 to 3. The adjustment of the coulier depth or lowering depth described in conjunction with FIGS. 4 to 13 can instead be applied accordingly also to ordinary flat knitting machines, especially those having revolving carriages, and also in the case of circular knitting machines with revolving cams. Aside from that, the lowering cams 48 can act on the butts of other knitting tools coupled with the knitting needles, as for example jacks or sinkers.

We claim:

1. Knitting machine having a needle bed in which knitting tools having projections are mounted for raising and lowering, with a cam unit which can be transported past the projections and which has at least one lowering cam acting on the projections of the knitting tools which is adjustable with regard to its lowering depth and is joined to a runner, and having a plurality of pathways associated each with a preselected lowering depth of the lowering cam, which interact according to the pattern with the runner during the movement of the cam unit past the projections of the knitting tools, for the setting of the lowering cam to a preselected lowering depth, characterized in that the runner (55) is movably connected with the lowering cam (48) and that a controller (106) which can be actuated before each passage of the cam unit (40) past the projections (39) of the knitting tools (15) is provided for the shifting of the runner (55) to the position required for interaction with a selected pathway (54).

2. Knitting machine of claim 1, characterized in that the controller (106) has at least one switch (107) whereby the runner (55) can be shifted to the necessary position.

3. Knitting machine of claim 1 or 2, characterized in that the lowering cam (48) is fastened fixedly and the runner (55) movably to a support (91).

4. Knitting machine of claim 3, characterized in that the runner (55) is mounted displaceably on an axle (94) fastened to the support (91).

5. Knitting machine of claim 4, characterized in that the runner (55) consists of a wheel mounted rotatably on the axle (94).

6. Knitting machine of claim 4, characterized in that the axle (94) is disposed perpendicularly to the length of the pathways (54).

7. Knitting machine of claim 3, characterized in that the support (91) is fastened movably on the cam unit (40) and is under the influence of a spring (93) which biases the runner (55) against the pathways (54).

8. Knitting machine of claim 2, characterized in that guides (103) are provided between the pathways (54) to guide the runner (55) during its interaction with the selected pathway (54).

9. Knitting machine of claim 8, characterized in that each switch (107) has a controllable switch body (108, 120) extended between two guides (e.g., 103*a*, 103*b*) over which the runner (55) is to pass, and steers the entering runner (55) either to the pathway formed by the two guides (103*a*, 103*b*) or to a pathway which is formed by one of the two guides (103*a*, 103*b*) and an additional guide (e.g., 103*c*) (FIG. 8).

10. Knittng machine of claim 9, characterized in that the switch body (108, 120) is so disposed that in its normal position it leaves the entering runner (55) unaffected.

11. Knitting machine of claim 9, characterized in that a controllable actuator is connected with each switch (107).

12. Knitting machine of claim 11, characterized in that the actuator has an electromagnet (112).

13. Knitting machine of claim 11 or 12, characterized in that the switch body (108) is linked to a lever (115) which is under the influence of the actuator and a return spring (118).

14. Knitting machine of any of claims 9 to 12, characterized in that the switch body (108) is constructed and disposed in the manner of a rocker cooperating with the riders running over it.

15. Knitting machine of claim 1, characterized by excentric cams (10) which can be coupled with the knitting tools (5) for the raising and lowering of the knitting tools, while for the adjustment of the magnitude of the movements in the lowering direction the drive connections of the knitting tools (5) to the cams (10) have free play so that the knitting tools (5) can be lowered by an amount corresponding to the free play in addition to the lowering produced by the cams, and the lowering cam (48) is designed for the additional lowering of the knitting tools (5) by a preselectable portion of this amount.

16. Knitting machine of claim 15, characterized in that the cams (10) are disposed on a rotatable drive shaft (7) at an angular offset, that the cam unit (40) is provided on a transport means disposed on the needle bed (3) such that the lowering cam (48) begins at a level which corresponds to the position of the projections (39) of the knitting tools (5) shortly before the end of a lowering produced by a cam (10), and that the speed of the transport means and the rotatory speed of the drive shaft are synchronized such that the movement of the cam unit is adapted to the phase positions of the individual knitting tools brought about by the angular displacement of the cams.

17. Knitting machine of claim 1, characterized in that a number of cam units (40) exceeding the number of systems is provided.

18. Knitting machine of claim 17, characterized in that a device is provided whereby each cam unit (40) arriving at the end of the needle bed (3) can be carried back to the start of the needle bed (3) without acting on the projections (39) of the knitting tools.

19. Knitting machine of claim 15, characterized in that, for the driving connection of the knitting tools (5) and cams (10) one drive element (12) each is provided, which is constantly connected operatively with the associated cam (10) in two directions corresponding to the raising and the lowering, and has a raising means (25) cooperating in the raising direction with a raising means (28) for the knitting tool (5) and a lowering means (24) cooperating in the lowering direction with a lowering means (29) for the knitting tool, the distance between the raising means (25) and the lowering means (24) of the drive element (12) being greater than the distance between the raising means (28) and the lowering means (29) for the knitting tool.

20. Knitting machine of claim 1, characterized in that a pattern-controllable coupling element (16) is provided for the driving connection of each of the knitting tools (5) and cams (10) and for the pattern-controlled connection of the drive elements (12) and the associated knitting tools.

21. Knitting machine of any of claims 9 to 12 and 15 to 20, characterized in that each switch has a wedge-shaped switch body (120) which can be displaced perpendicularly to the length of the rails and guides (53 and 103).

* * * * *